US007753706B2

(12) United States Patent
Liu et al.

(10) Patent No.: US 7,753,706 B2
(45) Date of Patent: Jul. 13, 2010

(54) SOCKET CONNECTOR WITH LOCKING DEVICE

(75) Inventors: Jia-Hau Liu, Tu-Cheng (TW); Cheng-Chi Yeh, Tu-Cheng (TW); Fang-Jwu Liao, Tu-Cheng (TW); Nan-Hung Lin, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/574,751

(22) Filed: Oct. 7, 2009

(65) Prior Publication Data

US 2010/0087085 A1 Apr. 8, 2010

(30) Foreign Application Priority Data

Oct. 7, 2008 (TW) ..... 97217900

(51) Int. Cl.
*H01R 13/62* (2006.01)

(52) U.S. Cl. ..... 439/331; 439/353

(58) Field of Classification Search ..... 439/331, 439/345, 353

See application file for complete search history.

(56) References Cited

U.S. PATENT DOCUMENTS

| | | | | |
|---|---|---|---|---|
| 6,916,195 | B2 | 7/2005 | Byquist | |
| 7,553,178 | B1 * | 6/2009 | Wertz et al. | 439/331 |
| 7,572,129 | B2 * | 8/2009 | Fan | 439/73 |
| 7,588,452 | B2 * | 9/2009 | Yeh | 439/331 |
| 7,628,634 | B2 * | 12/2009 | Yeh et al. | 439/331 |
| 2009/0264005 | A1 * | 10/2009 | Yeh et al. | 439/331 |
| 2010/0035458 | A1 * | 2/2010 | Yeh et al. | 439/345 |

* cited by examiner

*Primary Examiner*—Michael C Zarroli
(74) *Attorney, Agent, or Firm*—Andrew C. Cheng; Wei Te Chung; Ming Chieh Chang

(57) ABSTRACT

An electrical connector (100) for mounting on a printed circuit board (PCB) (1), includes an insulative housing (2), a plurality of electrical contacts (22) received in the insulative housing, a load plate (3) shielding the insulative housing, a screwing element (50) screwed onto the load plate and an elastic piece (51). The screwing element is screwed onto an upper surface of the load plate. The screwing element defines a channel (5010) therein. The elastic piece forms a pair of hook portions (511). The hook portions extend through the load plate and lock the screwing element at a locking position, the hook portions of the elastic piece engage the channel of the screw element so as to indicate the locking position.

11 Claims, 10 Drawing Sheets

SOCKET CONNECTOR WITH LOCKING DEVICE

CROSS-REFERENCE TO RELATED APPLICATIONS

This patent application relates to a co-pending U.S. patent application Ser. No. 12/386,637, filed on Apr. 20, 2009, entitled "SOCKET CONNECTOR ASSEMBLY HAVING LOCK-DOWN INDICATOR PREVENTING OVER-STRESSING", a co-pending U.S. patent application Ser. No. 12/547,509, filed on Aug. 26, 2009, entitled "SOCKET CONNECTOR WITH LOAD PLATE EQUIPPED WITH LOCKING DEVICE", a co-pending U.S. patent application Ser. No. 12/548,379, filed on Aug. 26, 2009, entitled "CPU SOCKET WITH LOCKING DEVICE" and a co-pending U.S. patent application Ser. No. 12/549,384, filed on Aug. 28, 2009, entitled "CPU SOCKET WITH LOCKING DEVICE", which are assigned to the same assignee with this application.

BACKGROUND OF THE INVENTION

1. Field of the Invention

The present invention relates generally to a socket connector, and more particularly to a socket connector with a locking device for indicating a degree of a load plate screwed onto a Printed Circuit Board (PCB) and then preventing overstress thereby.

2. Description of Related Arts

Normally, a Central Processing Unit (CPU) is usually disposed in a socket connector, and electrically connects to a print circuit board (PCB). The socket connector comprises a metallic cover and a metallic lever. The CPU is disposed into socket connector when the cover is disposed at an open position. Thereafter, the lever rotates to drive the cover to a closed position at which the cover exerts a pressure on the CPU to make sure that the CPU stays in the socket securely. Moreover, the lever locks with the cover in the closed position to prevent the cover undesirably rotating to the open position. Because the socket connector is fastened to the PCB only via the soldering portions of the contacts, it is relatively easy for the socket connector to be partially withdrawn from the PCB in a severe or vibrating environment, thus jeopardizing electrical connection between the socket connector and the PCB.

Hence, a socket connector with a locking device is desired.

SUMMARY OF THE INVENTION

Accordingly, an object of the present invention is to provide a socket connector with a locking device for indicating a degree of a load plate screwed onto a PCB and then preventing overstress thereby.

To achieve the above object, an electrical connector for mounting on a printed circuit board (PCB), includes an insulative housing, a plurality of electrical contacts received in the insulative housing, a load plate shielding the insulative housing, a screwing element screwed onto the load plate and an elastic piece. The screwing element is screwed onto an upper surface of the load plate. The screwing element defines a channel therein. The elastic piece forms a pair of hook portions. The hook portions extend through the load plate and lock the screwing element at a locking position, the hook portions of the elastic piece engage the channel of the screw element so as to indicate the locking position.

Other objects, advantages and novel features of the invention will become more apparent from the following detailed description when taken in conjunction with the accompanying drawings.

DETAILED DESCRIPTION OF THE PREFERRED EMBODIMENT

Figure 1:
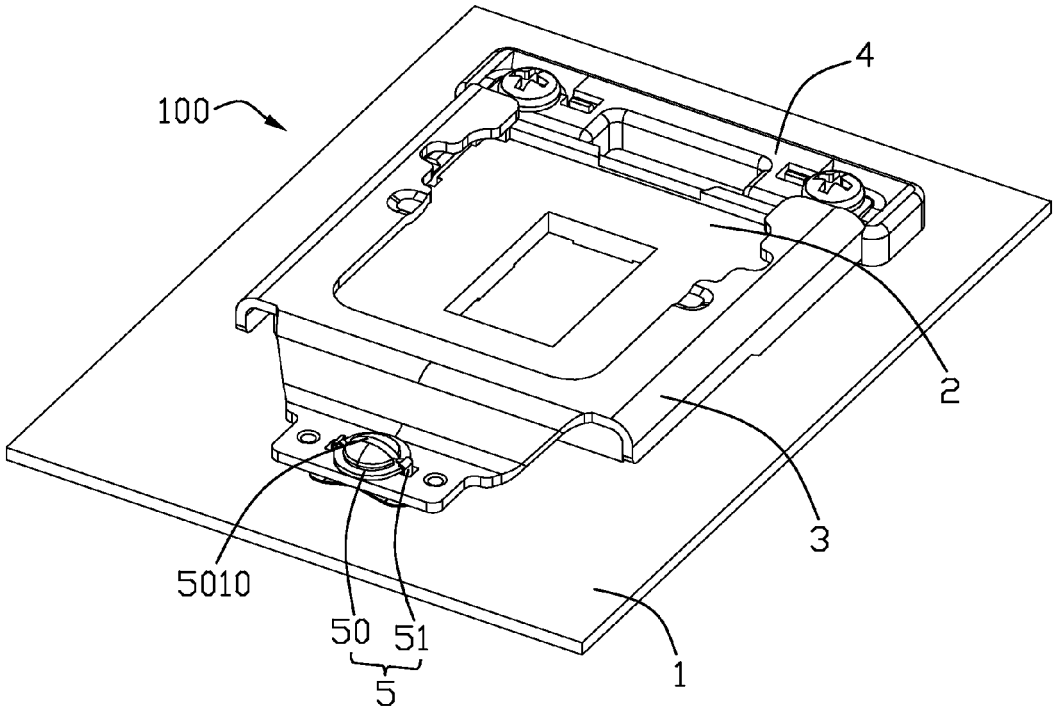
FIG. 1 is a perspective, assembled view of an electrical connector constructed in accordance with the present invention in a first embodiment.
Figure 2:
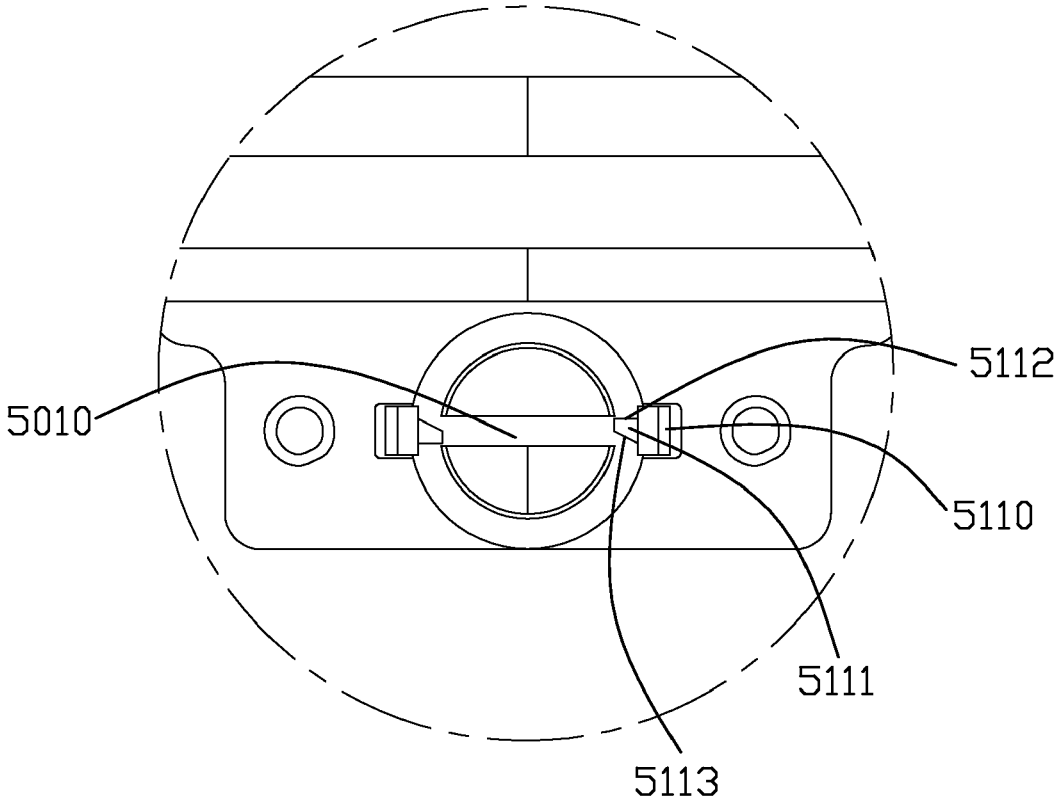
FIG. 2 is a part, enlarged and top plane view of the electrical connector of FIG. 1.

Referring to FIGS. 1-6, an electrical connector 100 of the present invention in a first embodiment, used for connecting a central processing unit (CPU, not shown) with a printed circuit board (PCB) 1, is described as following: the electrical connector 100 comprises an insulative housing 2 seated upon the PCB 1, a load plate 3 shielding the insulative housing 2, a connecting device 4 mounted on the PCB 1 for securing a back end of the load plate 3 to the PCB 1, a locking device 5 attached to a front end of the load plate 3 for securing the front end of the load plate 3 to the PCB 1 and a backboard 6 located beneath the PCB 1.

Figure 3:
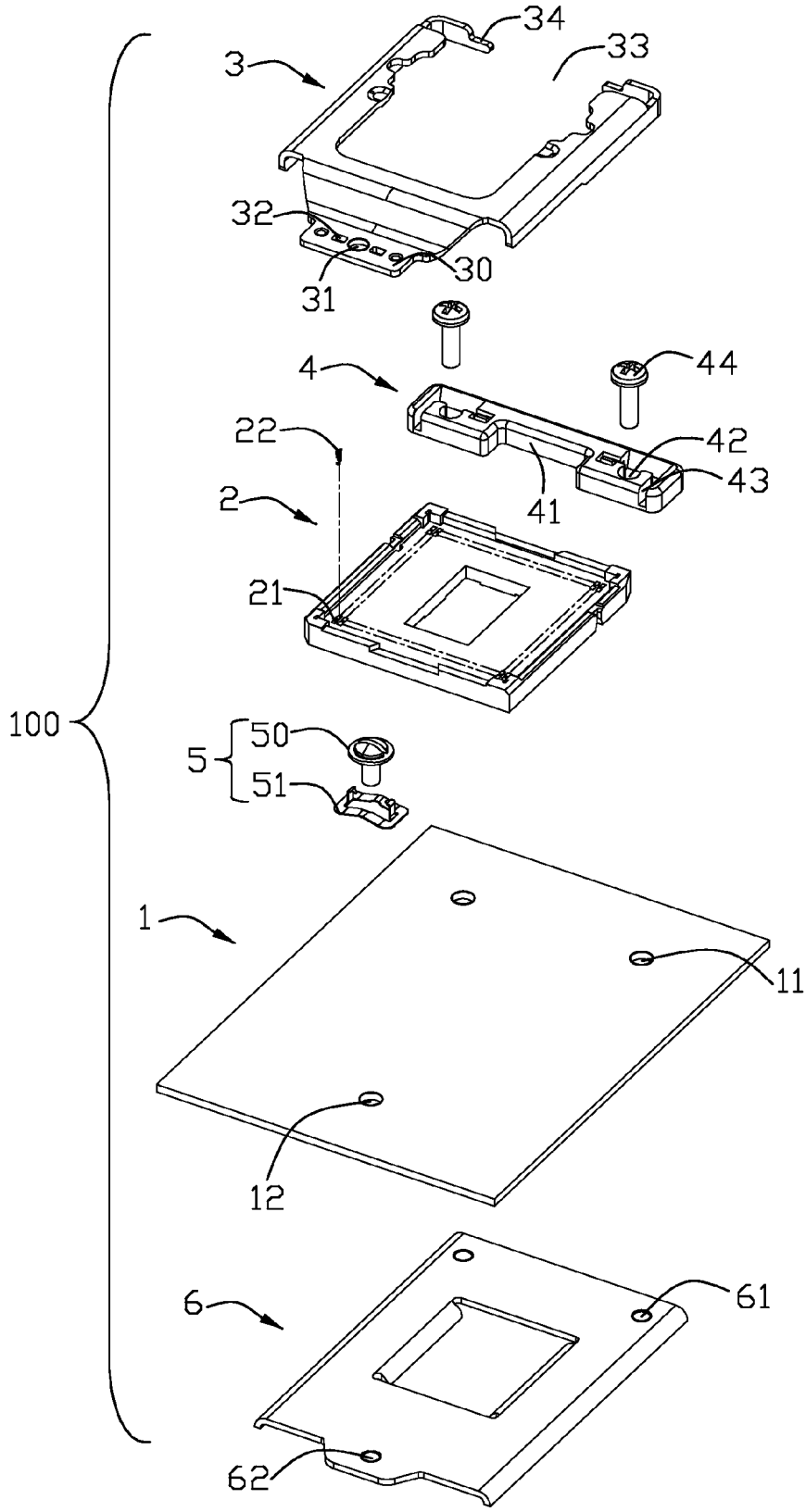
FIG. 3 is a perspective, exploded view of the electrical connector of FIG. 1.

Referring to FIG. 3, the insulative housing 2 defines a plurality of passageways 21 for receiving a plurality of electrical contacts 22, which are usually arranged in matrix. Each electrical contact 22 has a soldering portion (not labeled) for connecting with the PCB 1 and a contacting portion (not labeled) for connecting with a pin of the CPU so as to achieve electrical connection therebetween.

Referring to FIG. 3, the PCB 1 defines a pair of first apertures 11 at a back end thereof and a second aperture 12 at a front end thereof. The first apertures 11 and the second aperture 12 are respectively located two opposite sides of the insulative housing 2. In a preferred embodiment, the first apertures 11 and the second aperture 12 are disposed in a relation such that the first apertures 11 and the second aperture 12 are respectively located at vertices of an isosceles triangle. The backboard 6 located beneath the PCB 1, defines a pair of first slots 61 at a back end thereof corresponding to the first apertures 11 and a second slot 62 at a front end thereof corresponding to the second aperture 12. In correspondence with the first apertures 11 and the second aperture 12, the first slots 61 and the second slot 62 are disposed in a relation such that the first slots 61 and the second slot 62 are respectively located at vertices of an isosceles triangle, too.

Referring to FIGS. 3, the connecting device 4 is a substantially U-shaped configuration and includes two combining slots 42 on two ends thereof and a recess 41 defined between the two combining slots 42. Two connecting slits 43 are right-angled, recessed from a top surface of the connecting device 4, and communicate with each combining slot 42 from two ends thereof. The connecting device 4 further includes two pin members 44, such as bolts, which are received in the corresponding combining slots 42. The pin members 44 pass through the combining slots 42, the first apertures 11 of the PCB 1, and the first slots 61 of the backboard 6 in sequence. Thus, the connecting device 4 and the backboard 6 are both secured on the back end of the PCB 1.

Referring to FIG. 3, the load plate 3 is a hollow piece and forms a tongue portion 30 at a front part thereof. The tongue portion 30 defines a receiving hole 31 in the middle thereof and a pair of fastening holes 32 located at two opposite sides of the receiving hole 31. In an alternative embodiment, the receiving holes 32 communicate with the receiving hole 31 for performing as a unitary hole. The load plate 3 forms a pair of pivotal portions 34 at a rear part thereof. The pivotal portions 34 extend inwardly and define an interspace 33 therebetween. The pivotal portions 34 are securely received in the connecting slits 43 of the connecting device 4 and therefore, the rear end of the load plate 3 is pivotally attached to the PCB 1 by virtue of the connecting device 4.

Figure 4:
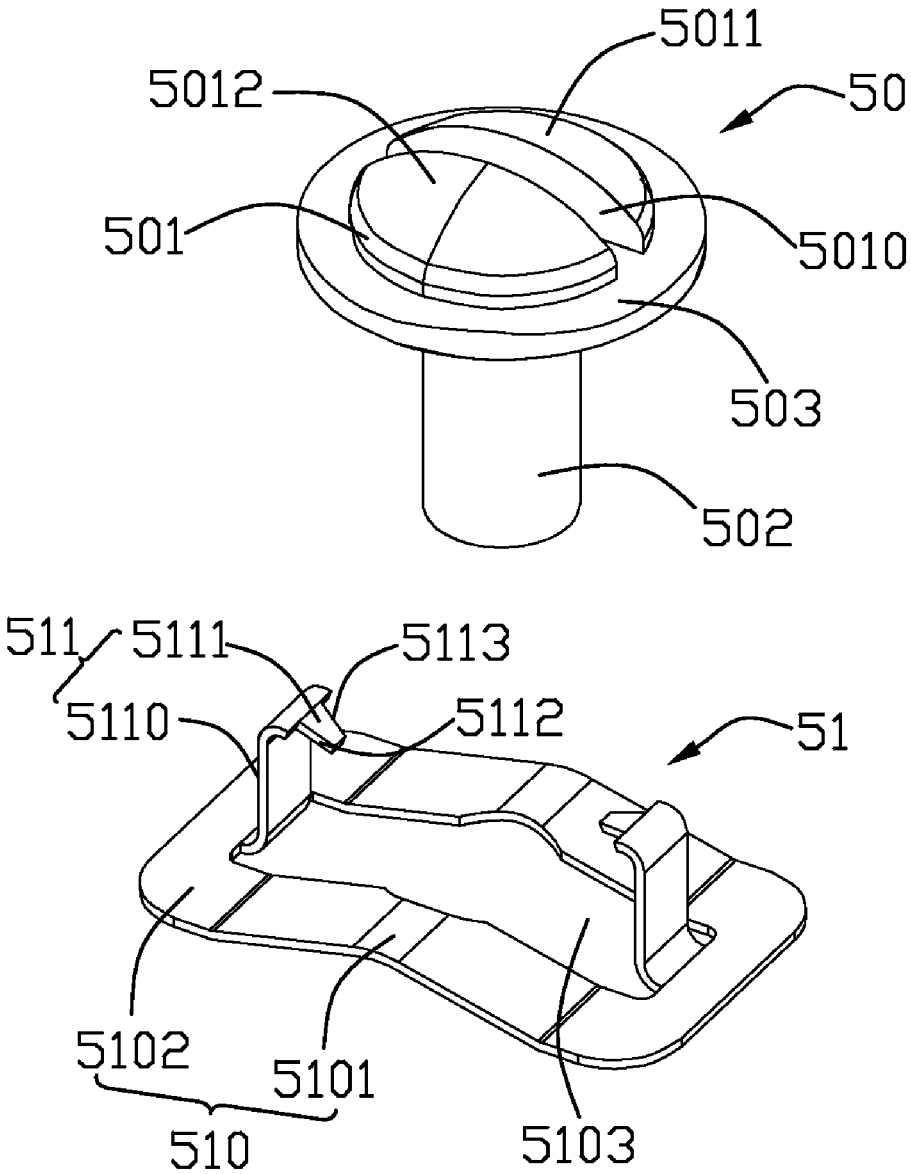
FIG. 4 is a perspective, exploded view of the locking device of the present invention.
Figure 5:
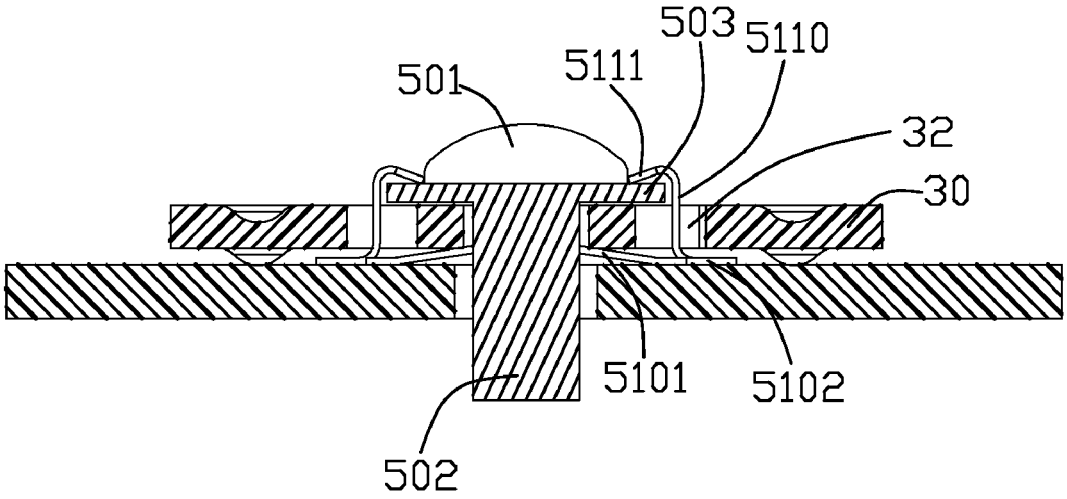
FIG. 5 is a cross-section view of the electrical connector of FIG. 1 before the load plate is firmly assembled to the PCB.
Figure 6:
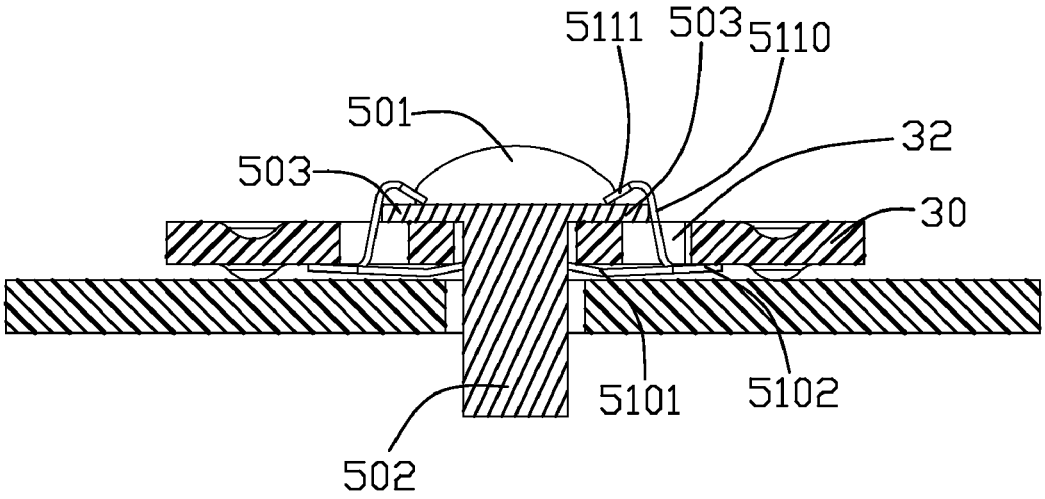
FIG. 6 is a cross-section view of the electrical connector of FIG. 1 after the load plate is firmly assembled to the PCB.
Figure 7:
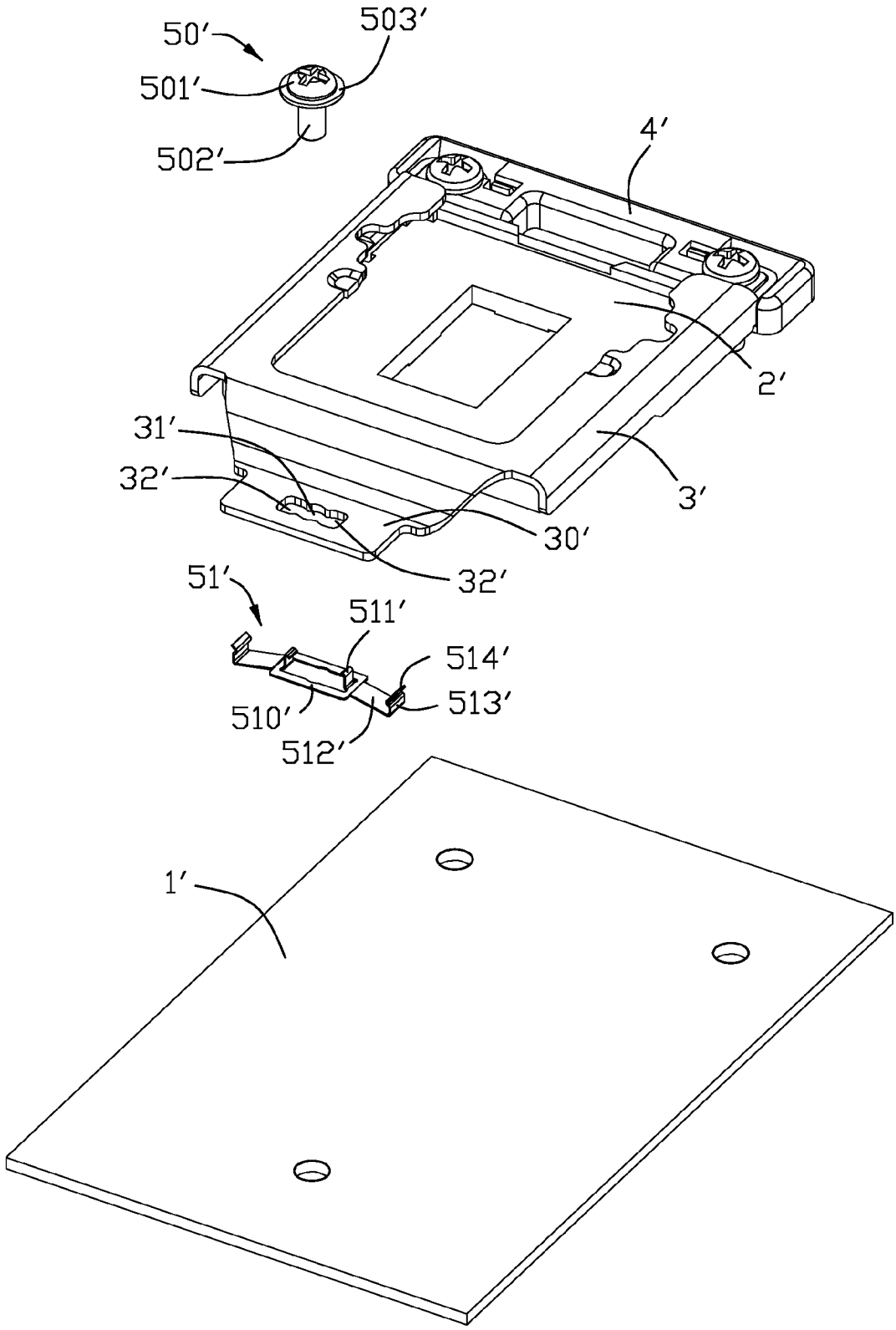
FIG. 7 is a perspective, exploded view of the electrical connector constructed in accordance with the present invention in a second embodiment.
Figure 8:
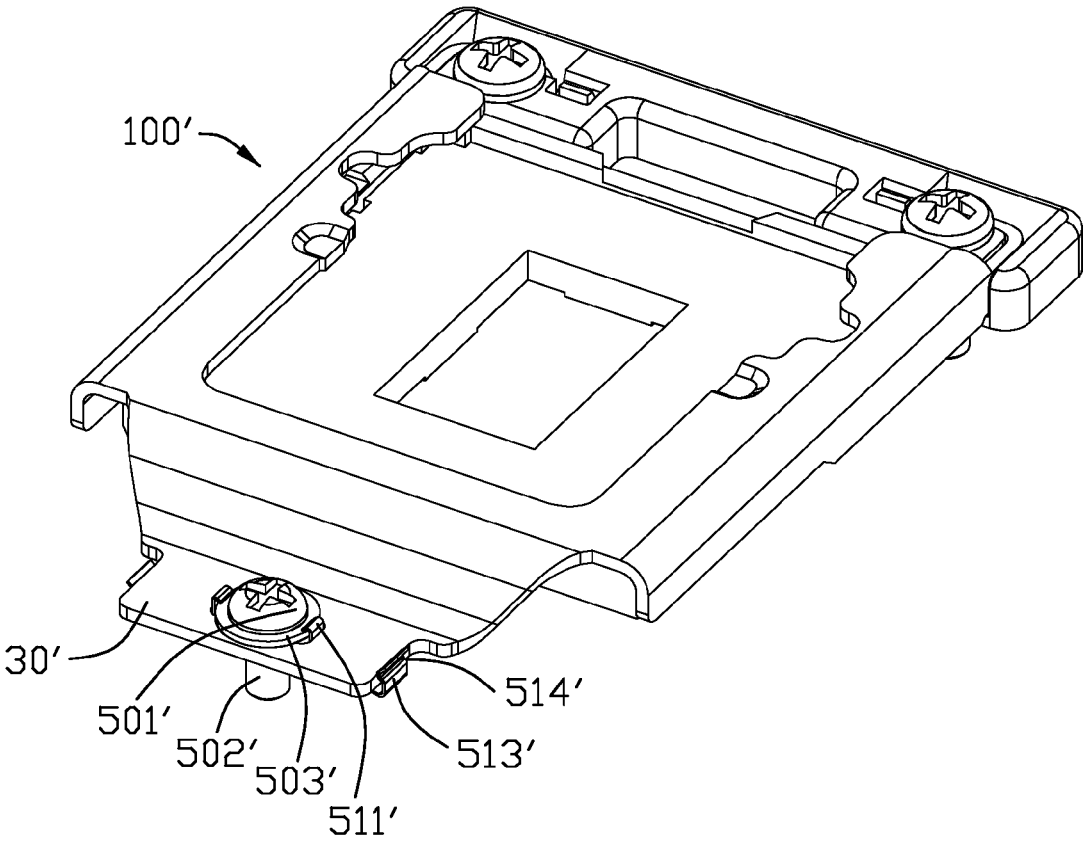
FIG. 8 is a perspective, assembled view of the electrical connector of FIG. 7 without the PCB.
Figure 9:
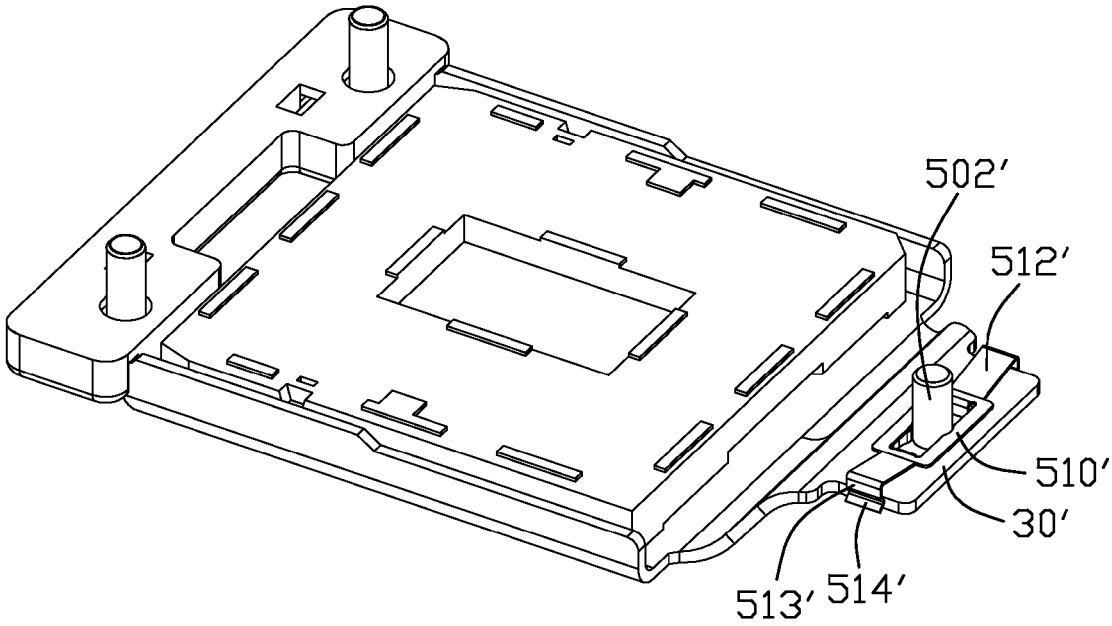
FIG. 9 is a view similar to FIG. 8 but taken from a different aspect.
Figure 10:
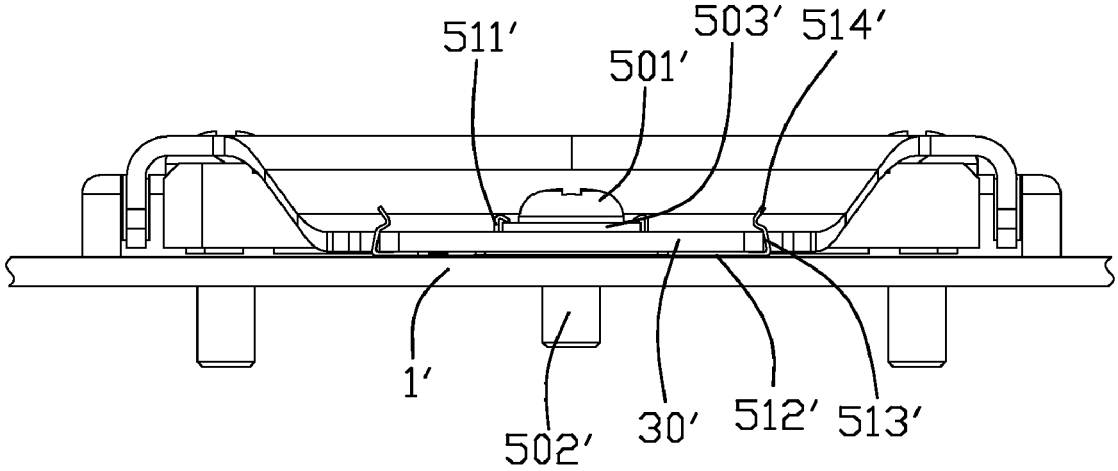
FIG. 10 is a cross-section view of the electrical connector of FIG. 7 after the load plate is firmly assembled to the PCB.

Referring to FIGS. 3-4, the locking device 5 comprises a screwing element 50 and an elastic piece 51 activating an attachment of the screwing element 50 to the tongue portion 30. The screwing element 50 comprises a cap portion 501, a screwing pole 502, and a washer 503. Both the screwing pole 502 and the washer 503 are integral with the cap portion 501. The washer 503 protrudes from a conjoining section between the cap portion 501 and the screwing pole 502. The cap portion 501 is divided into two hemisphere parts 5011, 5012 by a channel 5010. The elastic piece 51 is made of insulative material and comprises a base portion 510 and a pair of hook portions 511 extending upwardly and oppositely from the base portion 510. The base portion 510 comprises a pair of flexible arms 5101 and a pair of longitudinal arms 5102 connecting with the flexible arms 5101 for defining an opening 5103. The flexible arms 5101 can be pressed to deform and have elasticity. The hook portion 511 comprises a supporting portion 5110 and a fastening portion 5111 extending inwardly from the supporting portion 5110 towards the opening 5103. The fastening portion 5111 defines an acute edge 5112 perpendicular to the supporting portion 5110 and a bevel edge 5113 with respect to the channel 5010.

In assembling, the elastic piece 51 is attached to a lower surface of the tough portion 30 while the screwing element 50 is attached onto the upper surface of the tongue portion 30. The hook portions 511 go through the fastening holes 32 of the tongue portion 30 while the screwing element 50 goes through the receiving hole 31 to achieve engagement between the hook portions 511 and the cap portion 503 of the screwing element 50. Thereafter, the fastening portions 5111 of the hook portions 511 are leaned against the hemisphere parts 5011, 5012 of the cap portion 501. In the rotation of the screwing element 50, the flexible arms 5101 deform to have elasticity until the fastening portions 5111 of the hook portions 511 meet with the channel 5010. When the screwing element 50 is screwed to a locking position, the fastening portions 5111 of the elastic piece 51 will jump in the channel 5010 of the screw element 50 so as to indicate the locking position. Users can accept a great different sense therefrom. Accordingly, it prevents damage to the CPU and the PCB for overstress. The acute edge 5112 of the fastening portion 5111 prevents deviation of the hook portion 511 from the channel 5010 in a first direction while the bevel edge 5113 permits the deviation of the hook portion 511 from the channel 5010 in a second direction opposite to the first direction. During the screwing process, the supporting portions 5110 moves towards the screwing element 50.

Referring to FIGS. 7-10, an electrical connector 100' of the present invention in a second embodiment differentiates from the aforesaid electrical connector 100 at the elastic piece 51'. The elastic piece 51' comprises a base portion 510' and a pair of hook portions 511' extending upwardly from the base portion 510', and further comprises a pair of flexible arms 512' oppositely and outwardly extending from the base portion 510' and a pair of engaging portions 513' upwardly extending from the flexible arms 512'. Each engaging portion 513' further comprises a wrinkled portion 514'. The flexible arms 512' can be pressed to actuate the wrinkled portion 514' to interfere with the tongue portion 30', pronounce a sound for attracting ears of users, and thereby indicate users that no screwing stress is needed.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector for mounting on a printed circuit board (PCB), comprising:

an insulative housing;

a plurality of electrical contacts received in the insulative housing;

a load plate shielding the insulative housing;

a screwing element screwed onto an upper surface of the load plate, the screwing element defining a channel therein; and an elastic piece forming a pair of hook portions extending through the load plate, the elastic piece locking the screwing element at a locking position where the hook portions of the elastic piece engage the channel of the screw element so as to indicate the locking position.

2. The electrical connector as described in claim 1, wherein the hook portion comprises a supporting portion and a fastening portion extending from the supporting portion.

3. The electrical connector as described in claim 2, wherein the fastening portion is triangular and defines a bevel edge with respect to the channel.

4. The electrical connector as described in claim 2, wherein the supporting portion is capable of moving toward or away from the screwing element when said screwing element is locked to or unlocked from the load plate.

5. The electrical connector as described in claim 4, wherein the elastic piece comprises a base portion having a pair of flexible arms and a pair of longitudinal arms connecting with the flexible arms for defining an opening.

6. The electrical connector as described in claim 5, wherein the hook portions connect with the longitudinal arms.

7. The electrical connector as described in claim 6, wherein the flexible arms are deformable with respect to the screwing element.

8. The electrical connector as described in claim 7, wherein the load plate defines a hole located above the opening, and the screwing element passes through the hole and the opening in sequence.

9. The electrical connector as described in claim 7, wherein the screwing element comprises a cap portion and the cap portion is divided into two hemisphere parts by the channel.

10. An electrical connector, mounted on a printed circuit board (PCB), comprising:

an insulative housing;

a plurality of electrical contacts received in the insulative housing;

a load plate shielding the insulative housing;

a screwing element screwed onto an upper surface of the load plate; and an elastic piece forming a pair of hook portions and a pair of engaging portions apart from the hook portions, the hook portions extending through the load plate to lock with the screwing element in such a manner that the engaging portions interfere with the load plate for pronouncing to indicate a locking position.

11. The electrical connector as described in claim 10, wherein the engaging portions are connected to the hook portion by flexible arms which are deformable with respect to the engaging portions.

* * * * *